US008800541B2

(12) United States Patent
Hu

(10) Patent No.: US 8,800,541 B2
(45) Date of Patent: Aug. 12, 2014

(54) ELECTRIC TOY GUN

(76) Inventor: Shih-Che Hu, Tainan (TW)

( * ) Notice: Subject to any disclaimer, the term of this patent is extended or adjusted under 35 U.S.C. 154(b) by 570 days.

(21) Appl. No.: 13/155,398

(22) Filed: Jun. 8, 2011

(65) Prior Publication Data

US 2012/0240912 A1 Sep. 27, 2012

(30) Foreign Application Priority Data

Mar. 21, 2011 (TW) ..... 100109570 A

(51) Int. Cl.

| | |
|---|---|
| ***F41B 11/00*** | (2013.01) |
| ***F41B 11/646*** | (2013.01) |
| *F41B 11/57* | (2013.01) |
| *F41B 7/00* | (2006.01) |
| *F41B 11/642* | (2013.01) |

(52) U.S. Cl.

CPC ..... *F41B 11/646* (2013.01); *F41B 11/57* (2013.01); *F41B 7/003* (2013.01); *F41B 11/642* (2013.01)

USPC ..... 124/66; 124/32; 124/41.1; 124/45; 124/51.1; 124/67; 124/80; 446/473

(58) Field of Classification Search

CPC ..... F41A 9/61; F41F 1/00; F41B 7/006; F41B 11/646; F41B 11/57

USPC ..... 124/32, 41.1, 45, 51.1, 66, 67, 80; 446/473

See application file for complete search history.

(56) References Cited

U.S. PATENT DOCUMENTS

| | | | | |
|---|---|---|---|---|
| 3,369,535 | A * | 2/1968 | Bonanno | 124/29 |
| 5,261,384 | A * | 11/1993 | Hu | 124/66 |
| 5,381,928 | A * | 1/1995 | Lee et al. | 222/79 |
| 5,522,374 | A * | 6/1996 | Clayton | 124/59 |
| 6,564,788 | B1 * | 5/2003 | Hu | 124/66 |
| 7,100,592 | B1 * | 9/2006 | Yang | 124/67 |
| 7,458,371 | B2 * | 12/2008 | Ong et al. | 124/65 |
| 7,694,448 | B2 * | 4/2010 | Iwasawa | 42/54 |
| 7,730,881 | B1 * | 6/2010 | Pedicini et al. | 124/65 |
| 7,841,329 | B2 * | 11/2010 | Yang | 124/66 |
| 7,878,184 | B2 * | 2/2011 | Klarborg | 124/65 |
| 7,946,283 | B2 * | 5/2011 | Lee et al. | 124/67 |
| 7,963,281 | B2 * | 6/2011 | Pong | 124/67 |
| 7,975,682 | B2 * | 7/2011 | Yang | 124/67 |
| 8,091,542 | B2 * | 1/2012 | Hu | 124/77 |
| 8,100,120 | B2 * | 1/2012 | Maeda | 124/77 |
| 8,146,577 | B2 * | 4/2012 | Hu | 124/32 |
| 8,297,269 | B2 * | 10/2012 | Hu | 124/67 |
| 8,302,589 | B2 * | 11/2012 | Lee et al. | 124/66 |
| 8,453,633 | B2 * | 6/2013 | Tsai | 124/66 |
| 8,585,407 | B2 * | 11/2013 | Hu | 434/18 |

(Continued)

*Primary Examiner* — Gene Kim

*Assistant Examiner* — Alexander Niconovich

(74) *Attorney, Agent, or Firm* — Raymond Y. Chan; David and Raymond Patent Firm

(57) ABSTRACT

An electric toy gun includes a gun body carrying a piston set and a gear set having a first gearwheel provided with a side pin and rotatable to move the piston of the piston set, the gear set is arranged above the axis of movement of the piston of the piston set, a backlash vibration mechanism for producing a backlash vibration when the electric toy gun fires a bullet, and an attached cartridge carrier, which simulates the cartridge feeding operation of a real gun. The backlash vibration mechanism includes a connection block arranged on the axis of movement of the piston of the piston set, a weight fixedly connected to the bottom side of the connection block beneath the axis of movement of the piston.

5 Claims, 9 Drawing Sheets

(56) References Cited

U.S. PATENT DOCUMENTS

| | | | | |
|---|---|---|---|---|
| 2003/0098019 | A1* | 5/2003 | Hu | 124/66 |
| 2006/0231083 | A1* | 10/2006 | Tsurumoto | 124/66 |
| 2006/0243263 | A1* | 11/2006 | Tsurumoto | 124/66 |
| 2006/0283431 | A1* | 12/2006 | Lee et al. | 124/41.1 |
| 2007/0006862 | A1* | 1/2007 | Zimmerman | 124/66 |
| 2007/0101982 | A1* | 5/2007 | Ong et al. | 124/65 |
| 2007/0261689 | A1* | 11/2007 | Tai et al. | 124/67 |
| 2007/0289586 | A1* | 12/2007 | Tsurumoto | 124/73 |
| 2008/0078369 | A1* | 4/2008 | Yeung | 124/67 |
| 2008/0155875 | A1* | 7/2008 | Iwasawa | 42/54 |
| 2009/0101130 | A1* | 4/2009 | Hu | 124/80 |
| 2009/0127758 | A1* | 5/2009 | Hu | 267/167 |
| 2009/0217919 | A1* | 9/2009 | Pong Chun Chung | 124/80 |
| 2009/0235911 | A1* | 9/2009 | Klarborg | 124/66 |
| 2010/0065032 | A1* | 3/2010 | Yang | 124/27 |
| 2011/0214654 | A1* | 9/2011 | Lee et al. | 124/31 |
| 2011/0283984 | A1* | 11/2011 | Hu | 124/77 |
| 2011/0318715 | A1* | 12/2011 | Markert et al. | 434/18 |
| 2012/0138038 | A1* | 6/2012 | Lee | 124/80 |
| 2012/0208430 | A1* | 8/2012 | Kung et al. | 446/473 |
| 2012/0240912 | A1* | 9/2012 | Hu | 124/80 |

* cited by examiner

ELECTRIC TOY GUN

BACKGROUND OF THE PRESENT INVENTION

1. Field of Invention

The present invention relates to electric toy guns and more particularly, to such an electric toy gun, which is equipped with a backlash vibration mechanism, which causes the electric toy gun to produce a backlash vibration when firing a bullet and is so arranged to assure operation stability of the electric toy gun, and an attached cartridge carrier, which simulates the cartridge feeding operation of a real gun when the user triggers the electric toy gun.

2. Description of Related Arts

To simulation of a real automatic gun, an electric toy gun (air soft gun/BB-gun) may be provided with a backlash vibration mechanism. FIG. 1 illustrates a conventional electric toy gun, which comprises a backlash vibration mechanism a', a piston-cylinder mechanism b', a gun shell c', a transmission mechanism d', a trigger e' and a bullet pusher f'. As illustrated, the piston-cylinder mechanism b' comprises a piston 10 and a piston spring 101. The backlash vibration mechanism a' comprises a weight 30 and a reaction spring 40. The backlash vibration mechanism a' is arranged at the rear side in axial alignment with the piston 10 of the piston-cylinder mechanism b'. When pressed the trigger e', the transmission mechanism d' is forced to move the piston-cylinder mechanism b', causing the bullet pusher f' to push the bullet into the firing position for striking by (the firing pin of) the piston 10. During movement of the transmission mechanism d', the piston 10 is moved backwards, forcing the weight 30 against the reaction spring 40. When over the compression limit of the reaction spring 40, the reaction spring 40 forces the weight 30 forwards, and the piston 10 is moved forwards in a rush to shoot the bullet. During forward movement of the weight 30, a reactive force is produced, causing a backlash vibration. This backlash vibration is produced each time the trigger e' is pressed. Similar backlash vibration designs are seen in Taiwan Patent Nos. M374045; I 304469; I 1317805.

However, different electric toy guns have different space designs. To an electric toy gun that has no extra space in the rear side of the gun shell c' for accommodating the backlash vibration mechanism a', the gun structure must be re-designed so that a backlash vibration can be produced each time the trigger is pressed. Taiwan Patent NO. I 304469 teaches the installation of a backlash vibration mechanism a' in the space above the piston-cylinder mechanism b' (see FIG. 2). However, the arrangement of the backlash vibration mechanism may lift the center of gravity of the electric toy gun, causing operation instability.

In a conventional big scale electric toy gun (air soft gun/BB-gun), the component parts are accommodated inside the gun body. The feeding of the toy bullets (air-soft bullets) is unlike the feeding of a belt of cartridges of a real gun, i.e., a conventional electric toy gun cannot simulate the cartridge feeding operation of a real gun. Thus, conventional electric toy guns cannot enhance the player's game interest.

Therefore, it is desirable to provide an electric toy gun, which can simulate the cartridge feeding operation of a real gun during firing.

SUMMARY OF THE PRESENT INVENTION

The present invention has been accomplished under the circumstances in view. It is one object of the present invention to provide an electric toy gun, which is equipped with a backlash vibration mechanism, which causes the electric toy gun to produce a backlash vibration when firing a bullet and is so arranged to assure operation stability of the electric toy gun, and an attached cartridge carrier, which simulates the cartridge feeding operation of a real gun when the user triggers the electric toy gun.

To achieve this and other objects of the present invention, an electric toy gun comprises a piston set, a gear set, a backlash vibration mechanism mounted in a gun body thereof, and a gun barrel arranged on the gun body at a front side relative to the piston set. The gear set comprises a first gearwheel rotatable by an electric drive. The first gearwheel comprises a gear sector meshed with the piston set and rotatable to move the piston of the piston set, and a pin perpendicularly extended from one side thereof near the border. The backlash vibration mechanism comprises a connection block, a weight and a reaction spring. The connection block is arranged on the axis of movement of the piston of the piston set at a rear side relative to the piston spring and a front side relative to the reaction spring. The weight is fixedly connected to the bottom side of the connection block beneath the axis of movement of the piston of the piston set.

Further the gear set is arranged above the axis of movement of the piston of the piston set.

Further, the weight has a rear end thereof fixedly connected to the bottom side of the connection block, and a front end thereof extending to the bottom side of the gun barrel.

Further, the connection block comprises a front extension rod that supports the rear end of the piston spring, and a rear hole that receives the front end of the reaction spring.

Further, the reaction spring has a rear end thereof stopped at and fixedly connected to the inside wall of the gun body.

The electric toy gun further comprises an attached cartridge carrier arranged above the piston set. The attached cartridge carrier comprises a propelling member movable back and forth by the pin of the first gearwheel during rotation of the first gearwheel, a swivel hook member, which comprises a first end portion coupled to the propelling member and turnable back and forth by the propelling member during rotation of the first gearwheel, a second end portion, and a pivot portion pivotally coupled to the gun body, a cartridge rack hung on the second end portion of the swivel hook member and movable back and forth with the swivel hook member during rotation of the first gearwheel, and a return spring for returning the propelling member after the propelling member having been moved.

Further, the propelling member comprises a driven butt extended from one end thereof and movable by the pin of the first gearwheel.

Further, the driven butt has a beveled edge for abutment against the pin of the first gearwheel.

Further, the second end portion of the swivel hook member extends out of the gun body. The gun body is covered with a cover member. The cover member extends over the attached cartridge carrier.

Further, the propelling member comprises a retaining notch located on an opposite end thereof and coupled to the first end portion of the swivel hook member.

DETAILED DESCRIPTION OF THE PREFERRED EMBODIMENT

Figure 1:
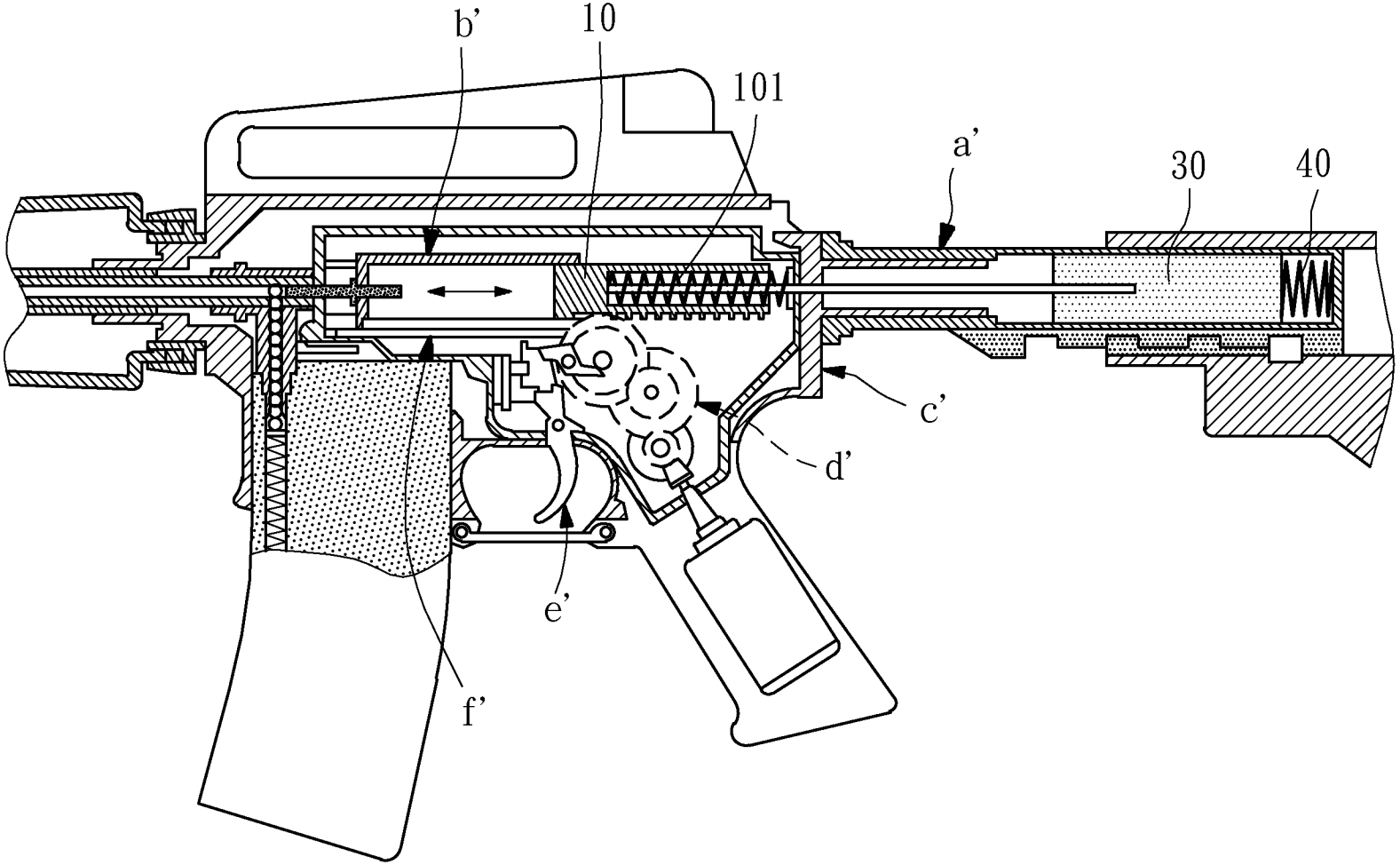
FIG. 1(PRIOR ART)
FIG. 1 is a schematic sectional side view of an electric toy gun according to the prior art.
Figure 2:
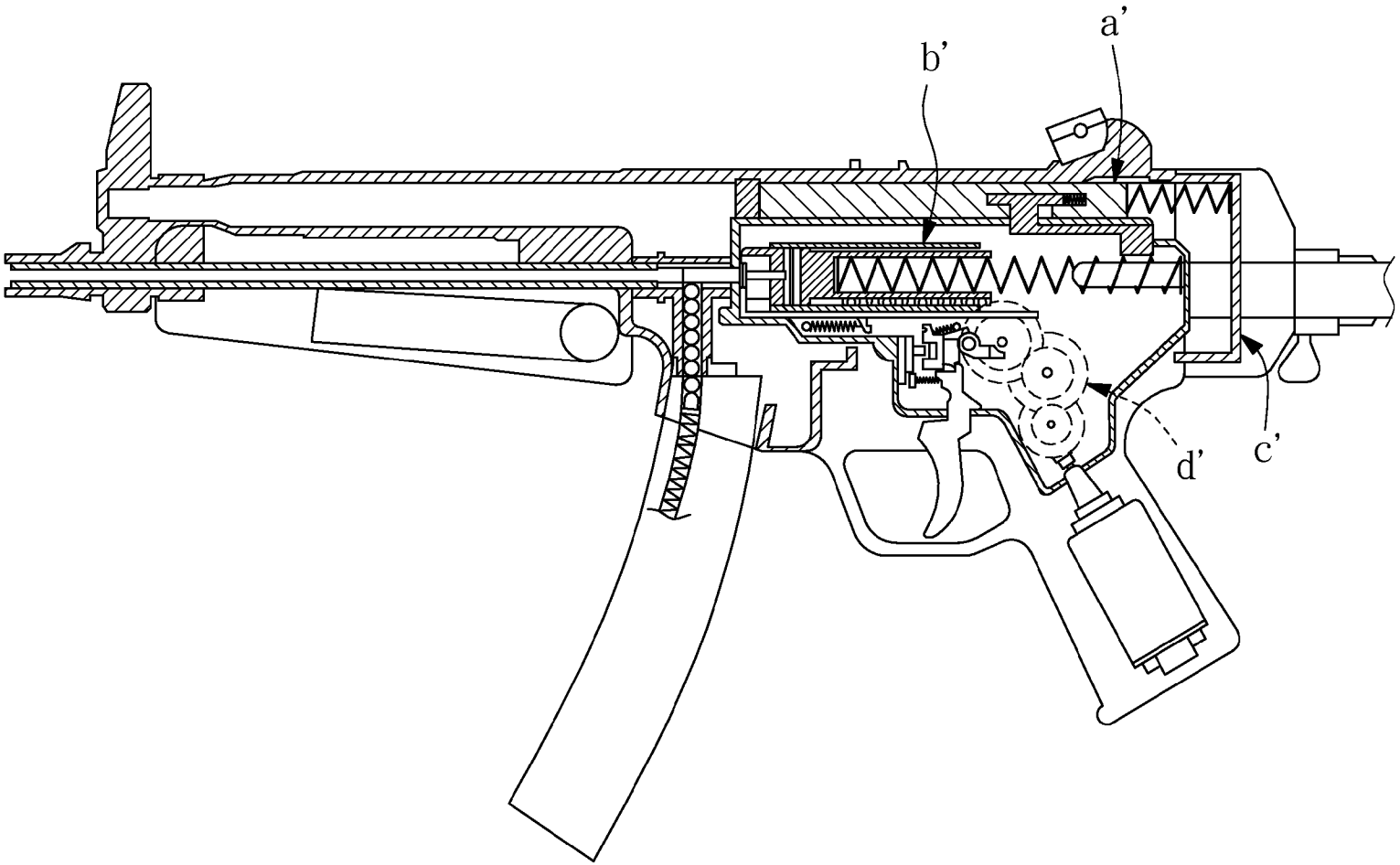
FIG. 2(PRIOR ART)
FIG. 2 illustrates the structural arrangement of a backlash vibration mechanism of another design of electric toy gun according to the prior art.
Figure 3:
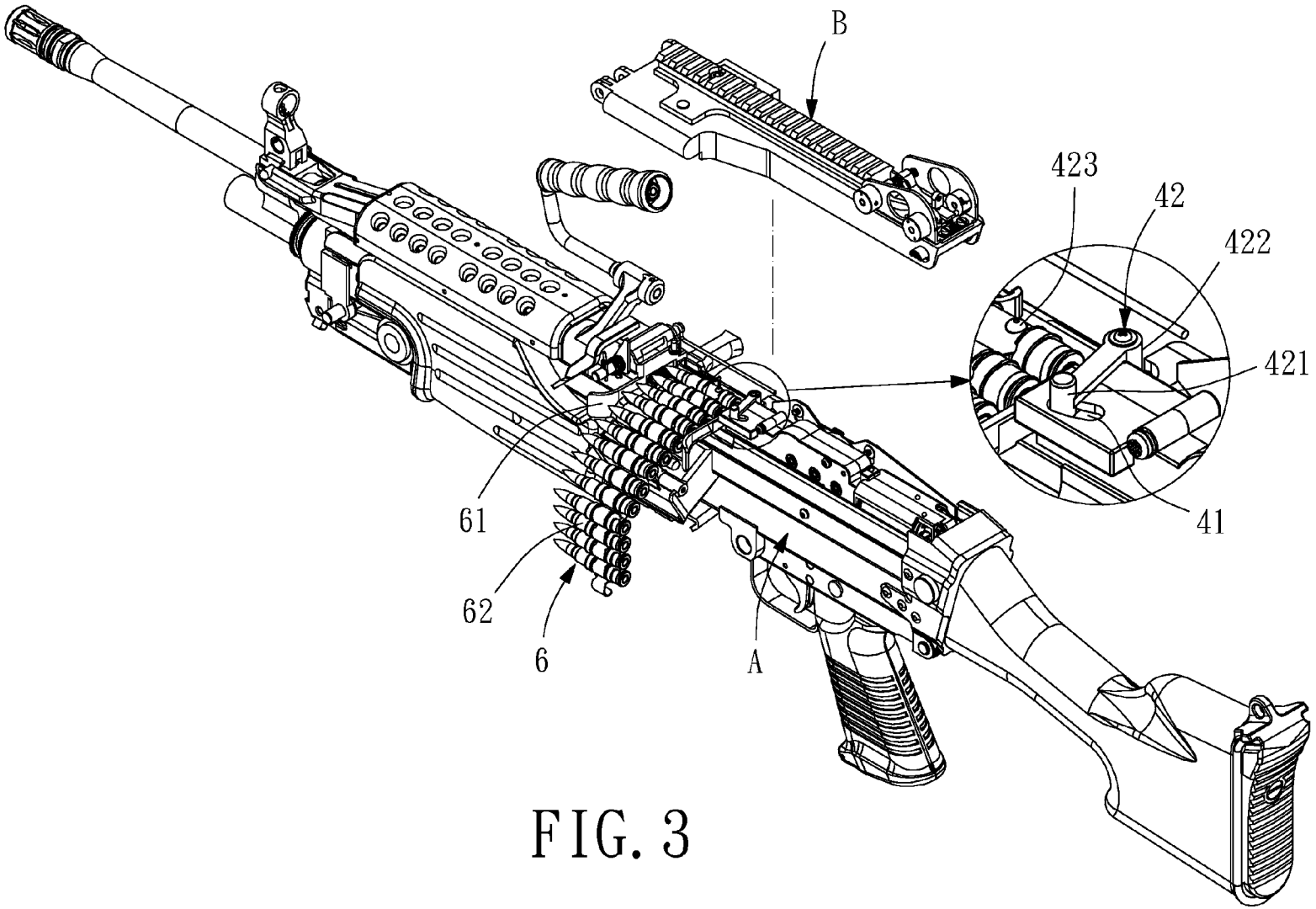
FIG. 3 is a perspective view, partially exploded and partially enlarged, of an electric toy gun in accordance with the present invention.
Figure 4:
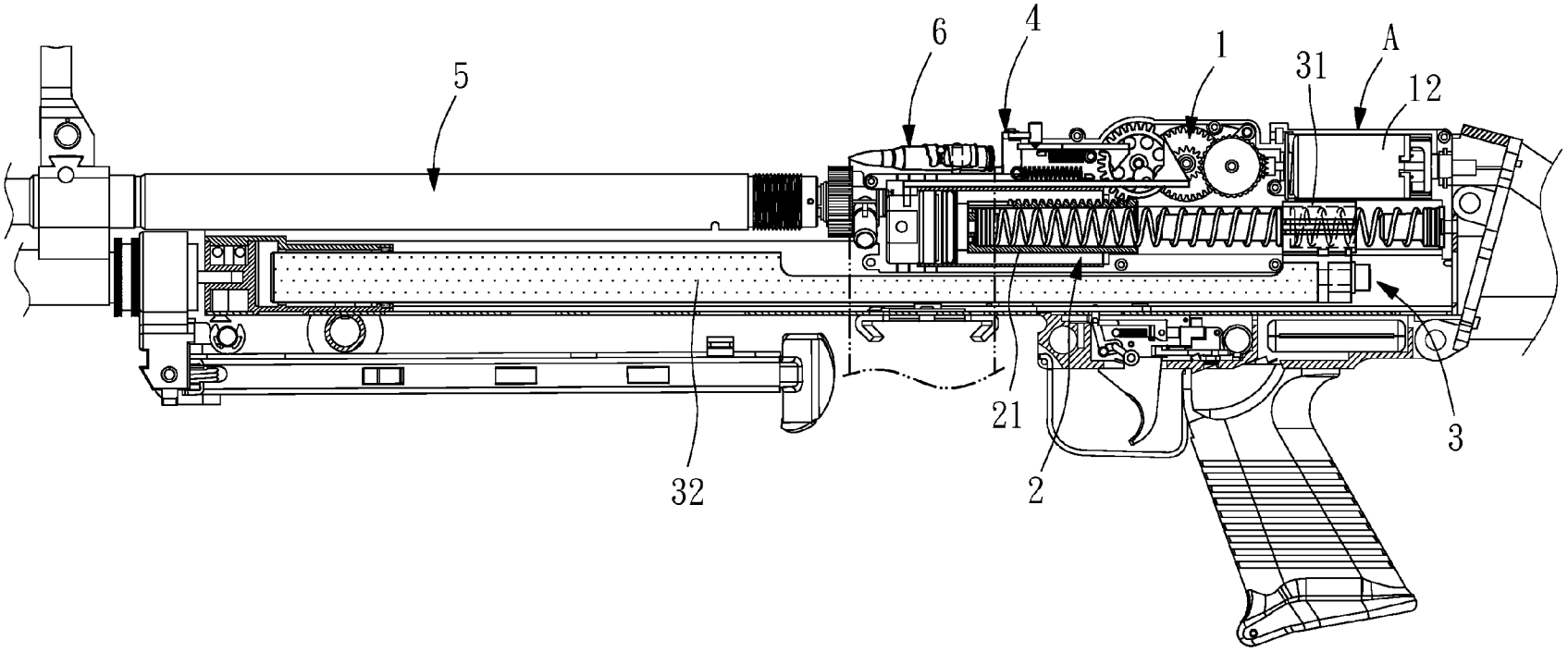
FIG. 4 is a side plain view of the electric toy gun in accordance with the present invention.

Referring to FIG. 3, an electric toy gun in accordance with the present invention is shown comprising a gun body A. The gun body A, as shown in FIG. 4, comprises a gear set 1, a piston set 2, a backlash vibration mechanism 3, and an attached cartridge carrier 4, which is arranged at the top side relative to the piston set 2.

The gear set 1 comprises a first gearwheel 11 (see FIG. 5) rotatable by an electric drive 12 (for example, electric motor). The first gearwheel 11 comprises a gear sector 111 disposed above and meshed with the piston set 2 and rotatable to move a piston 21 of the piston set 2, and a pin 112 perpendicularly extended from one side thereof near the periphery. Further, the gear set 1 is disposed above the axis of movement of the piston 21 of the piston set 2.

The piston set 2 comprises the aforesaid piston 21 (see FIG. 5), and a piston spring 22 attached to the piston 21. The piston spring 22 is compressed when the piston 21 is moved backwards by the gear sector 111 of the first gearwheel 11. When the first gearwheel 11 is rotated to a predetermined position, the gear sector 111 is disengaged from the piston 21, and the piston spring 22 is released from the constraint to push the piston 21 back to its former position (see FIG. 6). Further, a gun barrel 5 is provided at the front side of the piston set 2 (see FIG. 4).

Figure 5:
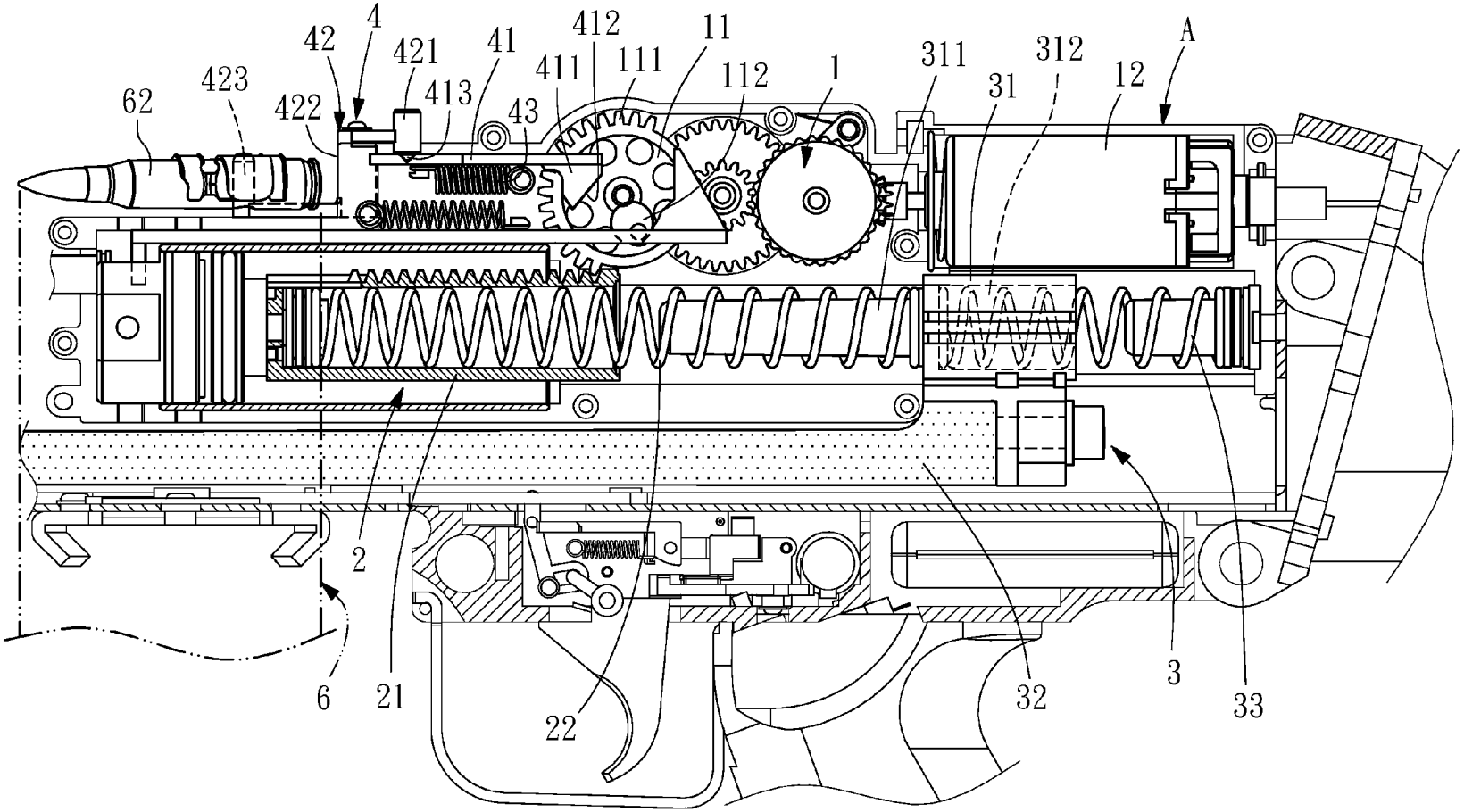
FIG. 5 is a plain view in an enlarged scale of the major part of the electric toy gun in accordance with the present invention.
Figure 6:
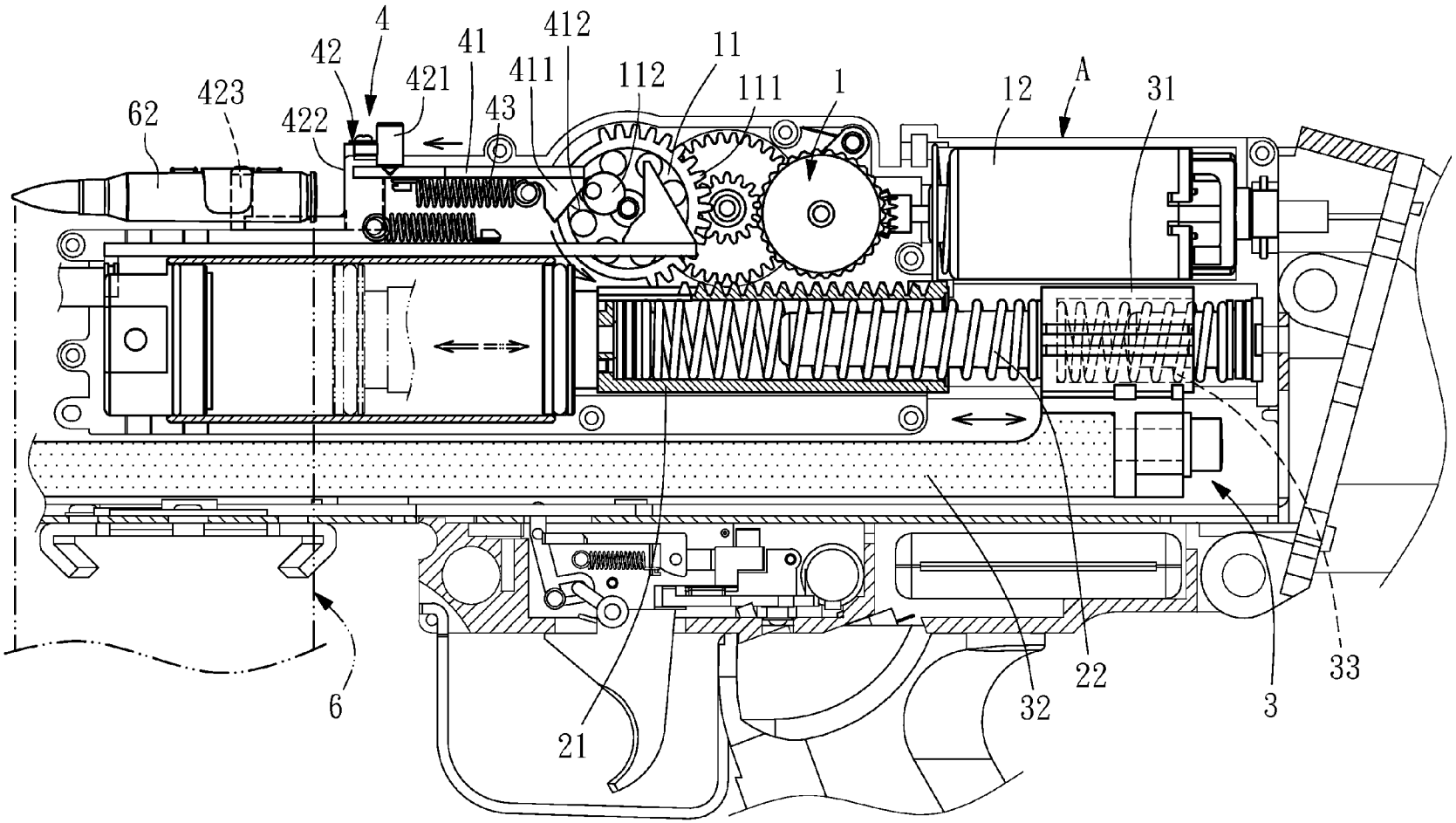
FIG. 6 corresponds to FIG. 5 illustrating an operation status of the toy gun.

The backlash vibration mechanism 3 comprises a connection block 31, a weight 32 and a reaction spring 33 (see FIG. 5). The connection block 31 is arranged on the axis of movement of the piston 21 of the piston set 2 at a rear side relative to the piston spring 22 and a front side relative to the reaction spring 33. The connection block 31 has a front extension rod 311 that supports the rear end of the piston spring 22, and a rear hole 312 that receives the front end of the reaction spring 33. The weight 32 has its rear side connected to the bottom side of the connection block 31, and is disposed beneath the axis of movement of the piston 21 of the piston set 2. Further, the front side of the weight 32 extends to the bottom side of the gun barrel 5 (see FIG. 4). Further, the reaction spring 33 has its rear end stopped against the inside wall of the gun body A and affixed thereto.

Figure 7:
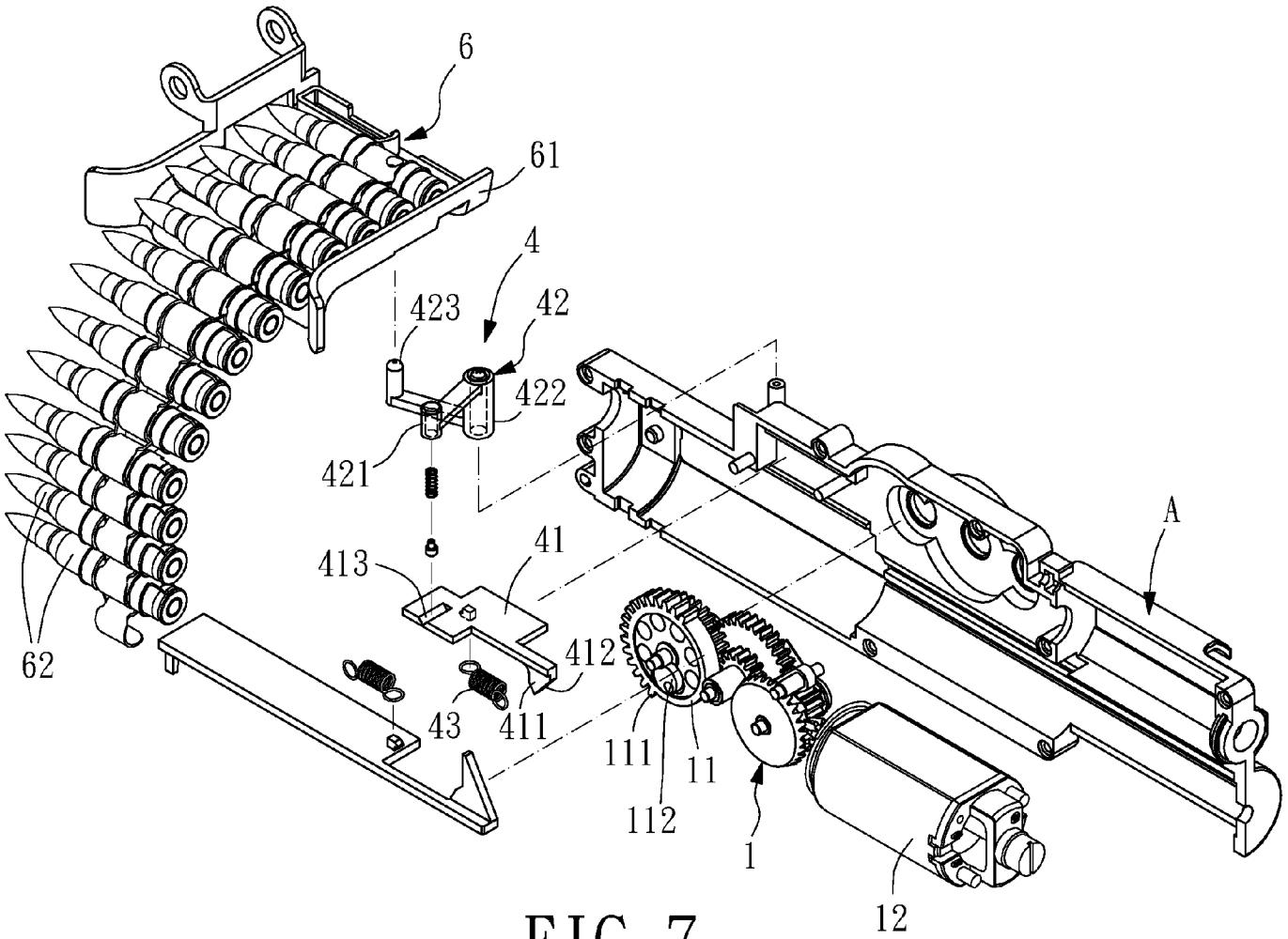
FIG. 7 is an exploded view of a part of the gun body of the electric toy gun in accordance with the preset invention, illustrating the structure of the gear set and the attached cartridge carrier.
Figure 8:
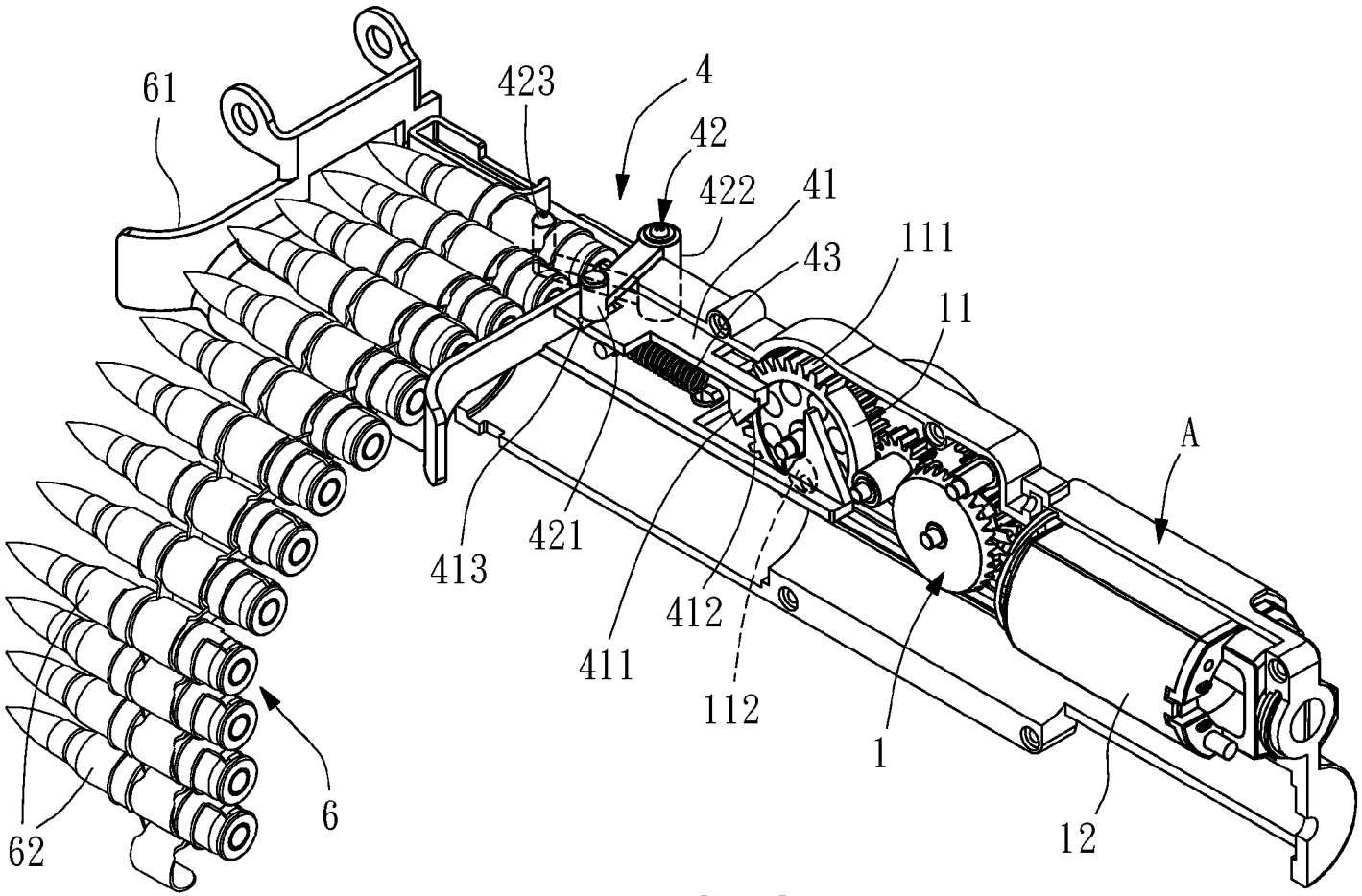
FIG. 8 is an assembly view of FIG. 7.
Figure 9:
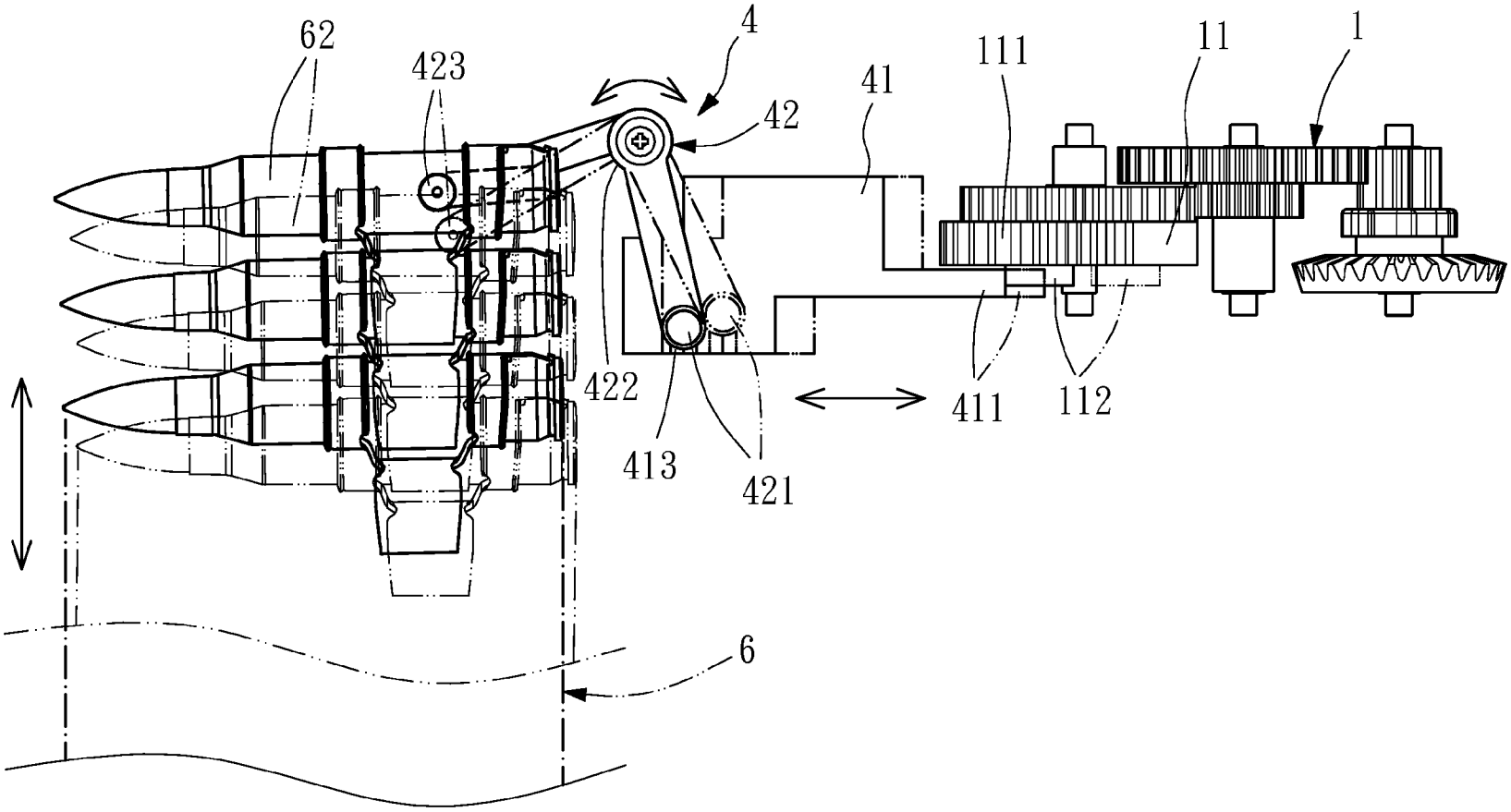
FIG. 9 is a schematic drawing of the present invention, illustrating the attached cartridge carrier moved back and forth during rotation of the gear set.

The attached cartridge carrier 4 (see FIGS. 7 and 8) comprises a propelling member 41, a swivel hook member 42, a cartridge rack 6 and a return spring 43. The return spring 43 is coupled to the propelling member 41, and adapted for returning the propelling member 41 after the propelling member 41 having been moved (see FIGS. 5 and 6). The propelling member 41 comprises a driven butt 411 extended from one end thereof. The driven butt 411 has a beveled edge 412. During rotation of the first gearwheel 11, the pin 112 will be moved to stop against the beveled edge 412 of the driven butt 411, thereby biasing the propelling member 41 (see FIG. 6). After the pin 112 is moved over the beveled edge 412 of the driven butt 411, the return spring 43 immediately returns the propelling member 41. The propelling member 41 further comprises a retaining notch 413 located on an opposite end thereof. The swivel hook member 42 comprises a first end portion 421, a second end portion 423, and a pivot portion 422 connected between the first end portion 421 and the second end portion 423. The first end portion 421 is coupled to the retaining notch 413 of the propelling member 41 (see FIG. 5). The pivot portion 422 is pivotally connected to the gun body A. The propelling member 41 is alternatively moved back and forth by the pin 112 of the first gearwheel 11 (see FIGS. 3 and 4), causing the first end portion 421 of the swivel hook member 42 to be turned back and forth by the propelling member 41, and therefore the pivot portion 422 is rotated relative to the gun body A to turn the second end portion 423 back and forth (see FIG. 9). Further, the second end portion 423 protrudes over the outside wall of the gun body A of the electric toy gun. Further, a cover member B is covered on the top side of the gun body A over the attached cartridge carrier 4 (see FIG. 3). The cartridge rack 6 comprises a rack 61 carrying a belt of mimic cartridges 62 (see FIGS. 7 and 8). The rack 61 is hung on the second end portion 423 of the swivel hook member 42 so that the belt of mimic cartridges 62 suspends outside the gun body A.

When the electric toy gun is operated to fire, the gear set 1 is rotated, causing the piston 21 of the piston set 2 to be moved by the gear sector 111 of the first gearwheel 11 (see FIG. 5). At this time, the piston spring 22 is compressed, and the weight 32 is synchronously moved backwards with the connection block 31 to compress the reaction spring 33 (see FIG. 6). When the piston 21 is released from the gear sector 111, it moves rapidly forwards to drive the bullet out of the electric toy gun, and the weight 32 is forced forwards by the reaction spring 33 to produce a reaction force, and therefore a backlash vibration is produced.

Further, when the user presses the trigger of the electric toy gun and keeps the trigger in the pressed position after the cartridge rack 6 has been hung on the second end portion 423 of the swivel hook member 42, the first gearwheel 11 is continuously rotated, and the pin 112 is moved with the first gearwheel 11 to push the propelling member 41 repeatedly at a predetermined time interval, causing the swivel hook member 42 to be turned back and forth by the propelling member 41 (see FIG. 9), and therefore the cartridge rack 6 is alternatively moved back and forth, simulating the cartridge feeding operation of a real gun.

As stated above, the backlash vibration mechanism 3 is arranged in the electric toy gun beneath the piston set 2, and the gear set 1 is arranged above the piston set 2, and therefore the electric toy gun can produce a backlash vibration like a real gun and the center of gravity of the gun body A is lowered, enhancing operation stability. Further, subject to the attached arrangement of the attached cartridge carrier 4 and the design of the pin 112 of the first gearwheel 11 for driving the propelling member 41 to turn the swivel hook member 42 back and forth, the cartridge rack 6 is alternatively moved back and forth to simulate the cartridge feeding operation of a real gun, enhancing the player's game interest and increasing the value of the product.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric toy gun, comprising:

a piston set;

a gear set comprising a first gearwheel rotatable by an electric drive, wherein said first gearwheel comprises a gear sector meshed with said piston set and rotatable to move a piston of said piston set, and a pin perpendicularly extended from one side thereof near a border, wherein said gear set is arranged above an axis of movement of said piston of said piston set;

a backlash vibration mechanism mounted in a gun body thereof, wherein a gun barrel is arranged on said gun body at a front side relative to said piston set, wherein said backlash vibration mechanism comprises a connection block, a weight, and a reaction spring, wherein said connection block is arranged on the axis of movement of said piston of said piston set at a rear side relative to a piston spring of said piston set and a front side relative to said reaction spring, wherein said weight is fixedly connected to a bottom side of said connection block beneath the axis of movement of said piston of said piston set; and an attached cartridge carrier arranged above said piston set, said attached cartridge carrier comprising:

a propelling member movable back and forth by said pin of said first gearwheel during rotation of said first gearwheel;

a swivel hook member comprising a first end portion coupled to said propelling member and turnable back and forth by said propelling member during rotation of said first gearwheel, a second end portion, and a pivot portion pivotally coupled to said gun body;

a cartridge rack hung on said second end portion of said swivel hook member and movable back and forth with said swivel hook member during rotation of said first gearwheel; and a return spring for returning said propelling member after said propelling member having been moved.

2. The electric toy gun as claimed in claim 1, wherein said propelling member comprises a driven butt extended from one end thereof and movable by said pin of said first gearwheel.

3. The electric toy gun as claimed in claim 2, wherein said driven butt has a beveled edge for abutment against said pin of said first gearwheel.

4. The electric toy gun as claimed in claim 3, wherein said second end portion of said swivel hook member extends out of said gun body; said gun body is covered with a cover member, and said cover member extending over said attached cartridge carrier.

5. The electric toy gun as claimed in claim 4, wherein said propelling member further comprises a retaining notch located on an opposite end thereof and coupled to said first end portion of said swivel hook member.

* * * * *